US007896762B2

(12) United States Patent
Schroeder

(10) Patent No.: US 7,896,762 B2
(45) Date of Patent: Mar. 1, 2011

(54) GRIP TRAINER FOR RACQUET SPORTS

(75) Inventor: Rod Schroeder, Highland Park, IL (US)

(73) Assignee: Rod Schroeder, Highland Park, IL (US)

( * ) Notice: Subject to any disclaimer, the term of this patent is extended or adjusted under 35 U.S.C. 154(b) by 688 days.

(21) Appl. No.: 11/743,592

(22) Filed: May 2, 2007

(65) Prior Publication Data

US 2008/0032831 A1 Feb. 7, 2008

Related U.S. Application Data

(60) Provisional application No. 60/796,897, filed on May 3, 2006.

(51) Int. Cl.
*A63B 49/08* (2006.01)

(52) U.S. Cl. ..... 473/551; 473/464

(58) Field of Classification Search ..... 473/551, 473/206, 464

See application file for complete search history.

(56) References Cited

U.S. PATENT DOCUMENTS

| | | | | | |
|---|---|---|---|---|---|
| 715,225 | A * | 12/1902 | Whitner | 473/206 |
| 1,694,992 | A * | 12/1928 | Stoeffler | 473/206 |
| 1,822,212 | A * | 9/1931 | Griffiths | 473/203 |
| 1,917,236 | A * | 7/1933 | Bloomstrand | 434/247 |
| 2,091,458 | A * | 8/1937 | Sleight | 16/421 |
| 3,256,023 | A * | 6/1966 | Frazelle | 473/206 |
| 3,817,521 | A * | 6/1974 | Wright | 473/551 |
| 4,072,311 | A * | 2/1978 | Bertucci | 473/551 |
| 4,402,508 | A * | 9/1983 | Pflueger | 473/551 |
| 4,848,746 | A * | 7/1989 | Klink | 473/551 |
| 5,143,375 | A * | 9/1992 | Wilkins | 473/204 |
| 5,366,218 | A * | 11/1994 | Gong | 473/551 |
| 5,897,440 | A * | 4/1999 | Bae et al. | 473/201 |
| 6,732,411 | B2 * | 5/2004 | Vidal | 16/430 |
| 6,916,260 | B1 * | 7/2005 | Poteet | 473/551 |
| 7,125,353 | B2 * | 10/2006 | Blount | 473/568 |
| 7,160,216 | B2 * | 1/2007 | Failla Colonnello Seppi et al. | 473/551 |
| 2008/0032831 | A1 * | 2/2008 | Schroeder | 473/464 |

OTHER PUBLICATIONS

Three (3) Photographs of the "Perfeck-Grip" by Avatar Sports, obtained Sep. 2006.

The First Serve by the Racquet Club of Lake Bluff; Published Dec. 1, 2005.

* cited by examiner

*Primary Examiner* — Raleigh W. Chiu

(74) *Attorney, Agent, or Firm* — McGuireWoods LLP

(57) ABSTRACT

A grip trainer for positioning a user's hand on a sports racquet includes a base configured to be removably attached to the sports racquet handle in a plurality of different positions that correspond to different grips related to the sport for which the racquet is designed for use, a finger positioning device that includes a generally cylindrical projection extending upwardly from the base and configured to position the user's hand on the racquet handle in one of the plurality of positions. A method of positioning a user's hand in any of the forehand, backhand, and service position on a tennis racquet also is disclosed.

8 Claims, 3 Drawing Sheets

GRIP TRAINER FOR RACQUET SPORTS

CROSS REFERENCE TO PRIOR APPLICATION

This application claims priority to and the benefit of U.S. Provisional Patent Application No. 60/796,897 filed on May 3, 2006, which is hereby incorporated by reference in its entirety for all purposes as if fully set forth herein.

BACKGROUND OF THE INVENTION

1. Field of the Invention

The invention relates generally to training apparatus for sports and, more particularly, to a grip trainer for positioning a user's hand on a sports racquet, such as a tennis racquet, to aid in proper hand placement upon the handle of the racquet.

2. Related Art

Persons learning a new racquet sport often have trouble mastering the proper techniques that must be acquired before tennis, badminton, racquetball, and the like can be played with ease and confidence. In particular, tennis players often have trouble learning a variety of grips needed to make certain strokes. Some of these grips include, but are not limited to, the forehand grip, the backhand grip, the serving grip, etc. The manner in which a tennis ball is served or returned, however, depends not only upon the form of the grip used but also upon whether the player's hand slips before or when the ball is hit. These problems can be exacerbated in younger players, for example, who also have a tendency to "choke up" on the racquet as they play, i.e., their hand positions tend to move upwards along the racquet handle toward the racquet strings. This is disadvantageous because a player loses power and control the more he or she "chokes up." Additionally, tennis players of all ages may over-rotate their hand. In the case of a right-handed player, this means that the player's hand and wrist tend to slip toward the right. A left-handed player's hand and wrist tend to slip toward the left. Over-rotation of the hand leads to improper stroke technique (forehand, backhand, serve, etc.), which reduces the players' ability to hit powerful, controlled shots.

Various training devices have been developed to teach players how to properly grip a tennis racquet. For example, the Grip Doctor Training Aid™ marketed and sold by Mansion Grove house and Mansion Select™ of Austin, Tex. is a two part system that purports to fit all hand sizes and attach to almost any tennis racquet handle. The first part of the system is a flexible piece of material configured at one end to slip over a player's index finder and configured at the opposite end to attach to the player's wrist. A strip of Velcro™ is attached to the portion of the flexible material that substantially covers the player's palm. The second part of the system is a piece of Velcro™ that is fixedly secured (smooth side down) to the racquet handle. The hooked/looped surface of this second piece of Velcro™ faces outwardly and removably engages the looped/hooked surface of the strip of Velcro™ attached to the player's palm. However, the Grip Doctor Training Aid™ is cumbersome to wear and may be uncomfortable to use. Additionally, there is no guarantee the player will grip the handle properly when the tennis racquet is picked up. Readjusting the player's hand once the racquet handle is grasped is cumbersome because the Velcro™ pieces have to be separated and then reconnected.

German Patent No. DE 3202194 A1 to Tiso discloses a pair of L-shaped brackets that are fixedly attached to opposite sides of a tennis racquet handle. Each L-shaped bracket has a generally flat upright portion and a generally flat base portion. The base portion of each L-shaped bracket is fastened to the tennis racquet handle using screws. For forehand play, the player grips the racquet by placing the inside of their thumb adjacent a first one of the pair of L-shaped brackets. For backhand play, the player grips the racquet by placing a second one of the pair of L-shaped brackets between their index and middle fingers. However, in this patent, the brackets are screwed into the handle of the racquet, which in practice may devalue or deface the racquet. Moreover, this type of structure is not easily adjustable, because a player would need tools and a significant amount of time to adjust, remove, or install the brackets. Another disadvantage is that the thin edges of the generally flat upright portions of the L-shaped brackets may chafe the player's hand during play. Yet another disadvantage with this bracket design is that it is not likely to be useful for serving.

U.S. Pat. No. 4,072,311 to Bertucci, discloses an index finger positioning device for tennis racquet handles. The positioning device is generally of an obtuse triangular construction having rounded ends and sides. It is tapered from its base to its apex, and is to be installed with its long side positioned generally transversely of the major axis of the racquet handle to separate the index finger from the remaining fingers. The positioning device is bonded or otherwise secured to a flexible mount strap having, for example, pressure sensitive adhesive at the ends thereof so that the strap may be wrapped about the racquet handle and secured at the proper point. The purpose of this device appears to be more of a performance-enhancing apparatus than an instructional teaching aid. For example, the positioning device separates the index finger from the remaining fingers for increased drive in forehand and backhand strokes, but the positioning device is not used at all during serves. Instead, in preparation for a serve, the racquet is rotated 180 degrees to permit conventional grasping of the racquet handle without interference of the positioning device. Consequently, a player may benefit from increased drive using forehand and backhand grips, but may hold the racquet improperly during a serve and thereby experience decreased drive and/or control. Moreover, this device may not be effective to prevent over-rotation of the hand common with beginners.

Thus, there is a need for an improved grip trainer for racquet sports, such as tennis, squash, badminton, or the like, that is easily and removably attachable to a racquet handle, readily prevents over-rotation of the hand, can be used to teach a player the proper grip for at least, but not limited to, backhand play, forehand play, and serving, and is particularly adapted for use as a teaching aid for young children.

SUMMARY OF THE INVENTION

The invention meets the foregoing needs and avoids the drawbacks and disadvantages of the prior art by providing a grip trainer for positioning a user's hand on a sports racquet. A grip trainer constructed according to the principles of the invention may include a base configured to be removably attachable to the sports racquet handle in a plurality of different positions corresponding to different grips related to the sport for which the racquet is designed for use. The grip trainer of the invention may also include a finger positioning device that includes a generally cylindrical projection extending upwardly from the base and is configured to position the user's hand on the racquet handle in one of the plurality of positions.

Additional features, advantages, and embodiments of the invention may be set forth in the following detailed description, drawings, and claims, including methods of using the invention to coach tennis. Although numerous implementations and examples of the invention are set forth herein—including in this "Summary of the Invention" section—the examples and implementations described herein are not intended to limit the scope of the invention.

BRIEF DESCRIPTION OF THE DRAWINGS

The accompanying drawings, which are included to provide a further understanding of the invention, are incorporated in and constitute a part of this specification to illustrate preferred embodiments of the invention. Together with the detailed description, the drawings serve to explain the principles of the invention. No attempt is made to show structural details of the invention in more detain than may be necessary for a fundamental understanding of the invention and the various ways in which it may be practiced. In the drawings.

DETAILED DESCRIPTION OF PREFERRED EMBODIMENTS OF THE INVENTION

Figure 1:
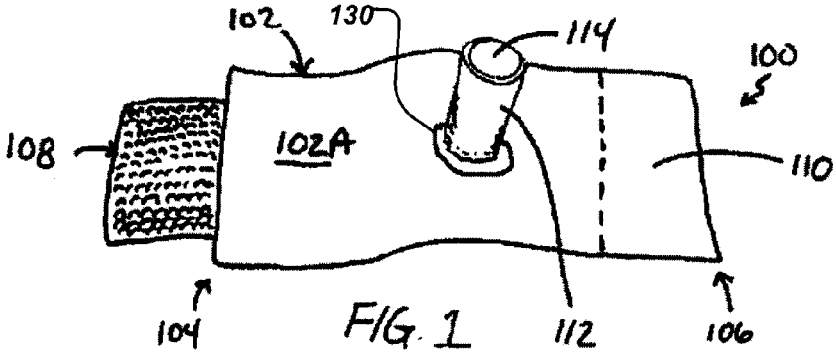
FIG. 1 is a top perspective view of a first embodiment of a grip trainer constructed according to the principles of the invention in which a finger positioning device is threadably attached to a wide, removable strap designed to fit around the handle of a tennis racquet.

The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and manufacturing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals may represent similar parts throughout the several views of the drawings.

FIGS. 1-8 herein illustrate various embodiments of a grip trainer of the invention that includes a finger positioning device and may be removably attached to a handle of a tennis racquet to teach proper hand position, preferably for at least serving, backhand play, and forehand play. Embodiments of the grip trainer of the invention are configured to prevent a player from "choking up" on the racquet during play and/or to prevent over-rotation of the player's hand. The grip trainer preferably is configured as a single piece, is easily and removably attached at a desired position on a racquet handle without the use of screws or hand tools, and does not to slip along the racquet handle once the grip trainer has been attached.

Figure 2:
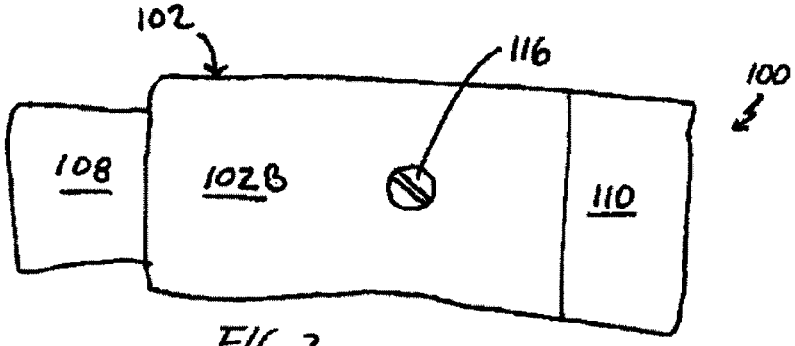
FIG. 2 is a bottom view of the grip trainer of FIG. 1.
Figure 3:
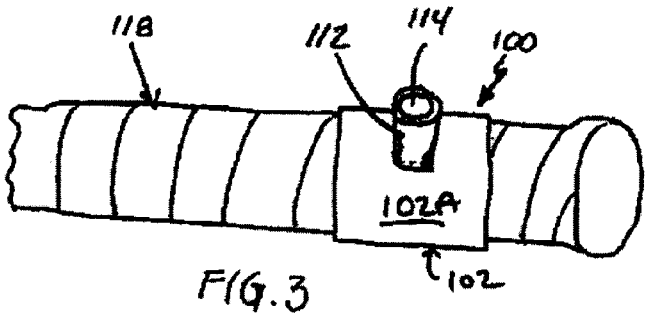
FIG. 3 is a side perspective view of the grip trainer of FIGS. 1 and 2 removably attached to a handle of a tennis racquet.

FIGS. 1-3 illustrate a first embodiment of a grip trainer 100 constructed according to the principles of the invention. FIG. 1 is a top perspective view of the grip trainer 100. FIG. 2 is a bottom view of the grip trainer 100 of FIG. 1. FIG. 3 is a side perspective view of the grip trainer 100 removably attached to a tennis racquet handle 118.

Referring to FIGS. 1-3, the grip trainer 100 includes a strip of material 102 that may be wrapped around a tennis racquet handle 118. The strip 102 has a first end 104 and a second opposite end 106, with respective portions 108, 110 of a fastening mechanism disposed at each end for securing the strip to the handle.

The finger positioning device is formed by a generally cylindrical hollow projection 112 attached to a central region of the top surface 102A of the strip 102, e.g., by a top connector 114 at the top of the finger projection 112, and a bottom connector 116 attached to a central region of the bottom surface 102B of the strip 102, and/or connected to the top connector 114 such that the finger projection 112 is sandwiched between top and bottom connectors 114 and 116 with the central portion of the strip 102 firmly connected between bottom connector 116 and the bottom of the finger projection 112. In this manner, the finger projection 112 is fixedly attached and extends upwardly from the strip 102, preferably at an angle approximately 90°.

The top connector 114 is illustratively shown as a threaded cap and the bottom connector 116 is illustratively shown as a screw. The threaded cap 114 may include a closed outer top surface and a generally cylindrical, hollow base, the interior bore of which (not shown) preferably is threaded to receive a corresponding thread formed on an outer surface of the screw 116. Either or both the top connector 114 and the bottom connector 116 may extend into a hollow bore of the finger projection 112. Additionally, the top connector 114 may be integrally formed with the finger projection 112, and/or the interior of the hollow bore of the finger projection 112 may be threaded to receive a corresponding thread formed on an outer surface of the bottom connector 116.

Figure 4:
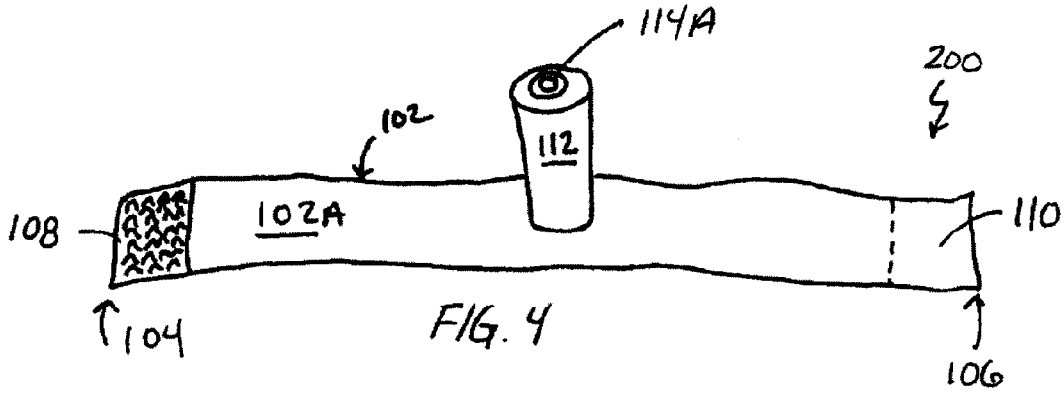
FIG. 4 is a top perspective view of a second embodiment of a grip trainer constructed according to the principles of the invention in which an embodiment of a finger positioning device is attached to a thin, removable strap by a rivet.
Figure 5:
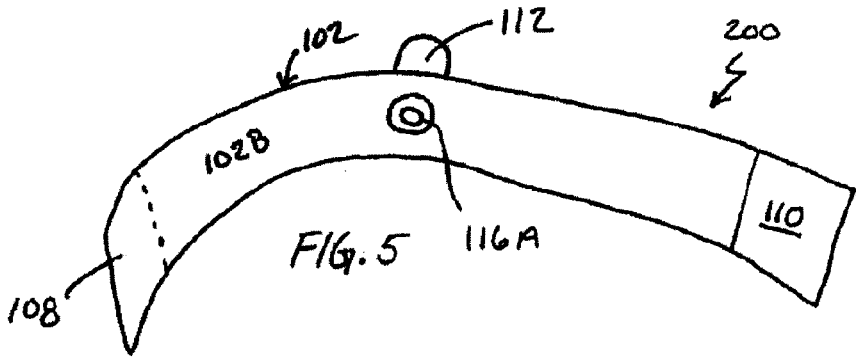
FIG. 5 is a bottom perspective view of the grip trainer of FIG. 4.
Figure 6:
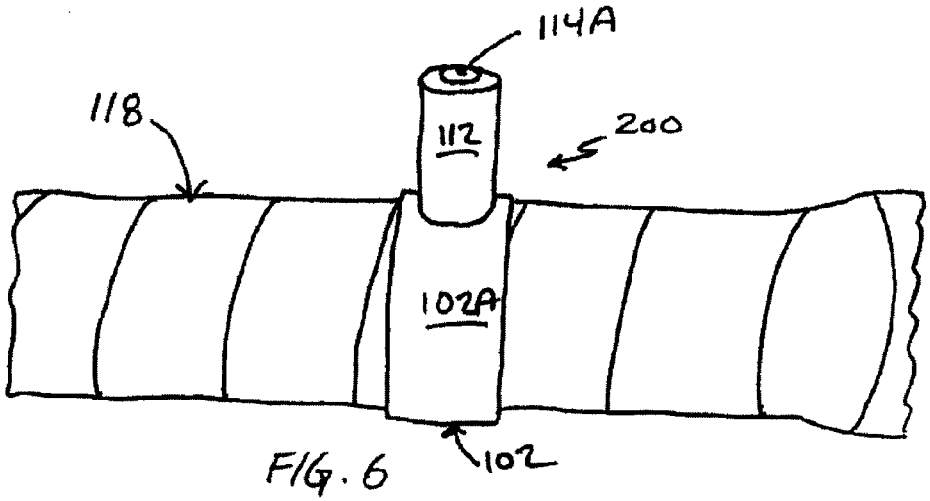
FIG. 6 is a top perspective view of the grip trainer of FIGS. 4 and 5 removably attached to a handle of a tennis racquet.

The grip trainer 100 of FIGS. 1-3 may be assembled by positioning the hollow finger projection 112, with an integrally or non-integrally formed threaded connector 114, over an opening in the strip 102, and then inserting a screw 116 through the strip 102 to rotatably engage and firmly tighten the screw to the top connector 114. While FIGS. 1-3 show a threaded engagement, any suitable attachment member may be used to fixedly attach the finger projection 112 to the strip 102. For example, as shown in FIGS. 4-6 and described subsequently, a rivet may be used.

Any suitable material may be used for the strip 102, which may vary in width and length depending on the type of sport being played and/or the exterior dimension of the racquet handle to which the grip trainer 100 is removably attached. By way of example and not limitation, the strip 102 may vary in width from about ⅜ inch to about 3 inches and in length from about 5 inches to about 8 inches. A stiffener 130 may be disposed between a portion of the strip 102 and the finger projection 112. For example, as shown in FIG. 1, the stiffener 130 may be included in an area of the strip 102 that contacts the bottom of the finger projection 112. The bottom side of the strip 102 may be textured and/or coated with a non-slip layer to increase frictional forces between the bottom side of the strip 102 and the racquet handle 118.

The fastener portion 108 attached to the first end 104 of the top surface 102A of the strip 102 removably engages fastener portion 110 attached to the second end 106. In FIGS. 1-3, fastener portions 108 and 110 are illustratively shown as hook-and-loop (Velcro) fasteners, but any suitable type of fastener known to a skilled artisan may be used. If hook-and-loop fasteners are used, the fastener portion 110 may be formed on the bottom surface 102B of the strip 102 at or near the end 106. In such an embodiment, the top surface of the fastener portion 108 may include a plurality of loops, and the bottom surface of the fastener portion 110 may include a corresponding plurality of hooks that removably engage the loops of fastener portion 108 when the fastener portions 108 and 110 are aligned and pressed together, as is known in the art.

The finger projection 112 may be formed of plastic, a polymer material, metal, other suitable material or combinations thereof. The outer surface of the finger projection 112 may be a smooth non-deformable material, a textured non-deformable material, a smooth deformable material, or a textured deformable material. "Deformable" describes a material that deforms under pressure exerted by one of more of the player's fingers. "Non-deformable" describes a material that does not deform under pressure exerted by one or more of the player's fingers. The outer surface of the finger projection 112 may have one or more finger contours formed therein (or attached thereto).

In FIGS. 1-3, the finger projection 112 is illustratively shown as a generally cylindrical, hollow, plastic spacer of the type commonly available in hardware stores. However, the finger projection 112 may be formed of any suitable material (or combination of materials) having any suitable shape. The dimensions of the finger projection 112 may vary depending on at least such factors as the age of the player using the grip trainer 100, the dimension of the outer surface of the racquet handle being used, and/or the type of sport being played, etc. Typically, younger players will use a projection 112 that has a smaller outer diameter than a projection 112 that is configured for use by adult players. By way of example and not limitation, the finger projection 112 may have an outer circumference in the range of about ¼ inch to about ⅝ inch, and a length in the range of about ⅝ inch to about 1 ¼ inches. As previously mentioned, the interior of the finger projection 112 may include a hollow bore that is either smooth or threaded to facilitate connection to strip 102.

FIGS. 4-6 illustrate a second embodiment of a grip trainer 200 constructed according to the principles of the invention that differs from the first embodiment illustratively shown in FIGS. 1-3 in several respects. First, in the second embodiment, the finger projection 112 is secured fixedly to the strip 102 with a rivet having an expanded top end 114A and a head 116A. The finger projection 112 may be connected to the strip 102 in this embodiment by inserting a free end 114A of the rivet through an opening in the strip 102 and through the hollow bore of the finger projection 112 such that the free end 114A protrudes beyond outward end of the finger projection 112. The free end 114A of the rivet is then flattened to fixedly attach the finger projection 112 to the flexible strip 102. Secondly, the width of the strip 102 is narrower than that shown in FIGS. 1-3; preferably it is only slightly wider than the diameter (or outer profile, if non-circular) of the finger projection 112. Third, the fastener portion 108 extends entirely across the first end 104 of the flexible strip 102. The other elements, materials, features, and workings of the second grip trainer 200 may be substantially similar to those described with reference to the first embodiment 100.

With reference to FIGS. 3 and 6, the grip trainer 100, 200 of the invention may be removably attached to the racquet handle 118 by first placing the strip 102 against the racquet handle 118. During placement of the strip 102, the racquet handle 118 may be grasped in the player's hand and the finger projection 112 may be held between the player's index and middle fingers. The player may then use his/her free hand to position the fastener portion 110 of the strip 102 above the fastener portion 108 such that the strip 102 is taut against the racquet handle 118. Once fasteners portions 110 and 108 are aligned, the player attaches them to each other by applying compressive pressure to the top surface of the end 106, which urges the fastener 110 towards the fastener 108. The grip trainer 100 may be removed by grasping an edge of the end 106 and pulling to disengage the fastener portion 110 from the fastener portion 108. Of course, a teaching professional may also assist in positioning the grip trainer 200 on the racquet handle 118 in a proper position.

Figure 7:
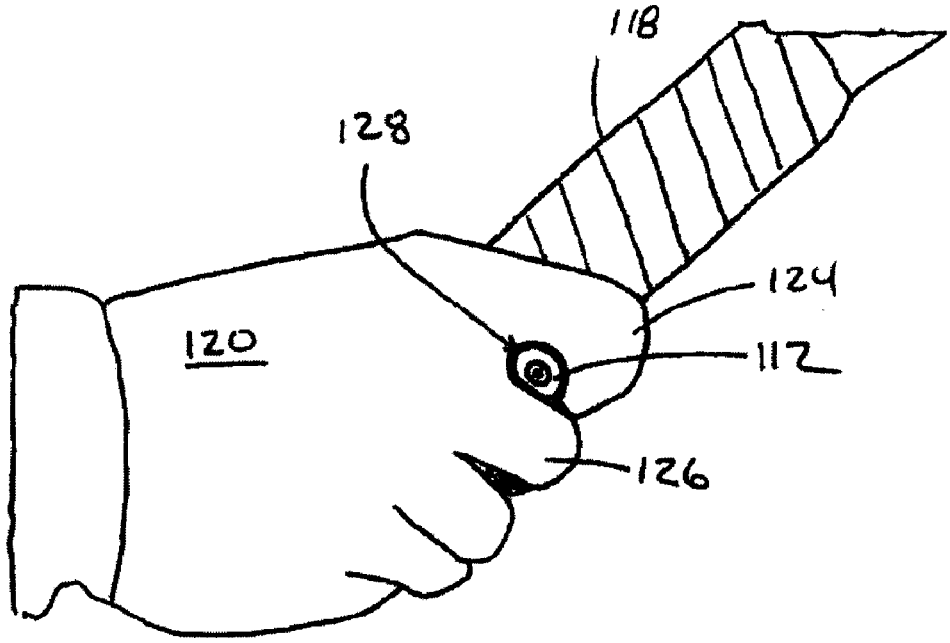
FIG. 7 is a side view of a right-handed grip using a grip trainer constructed according to the principles of the invention showing placement of the index and middle fingers about a projection of the grip trainer.
Figure 8:
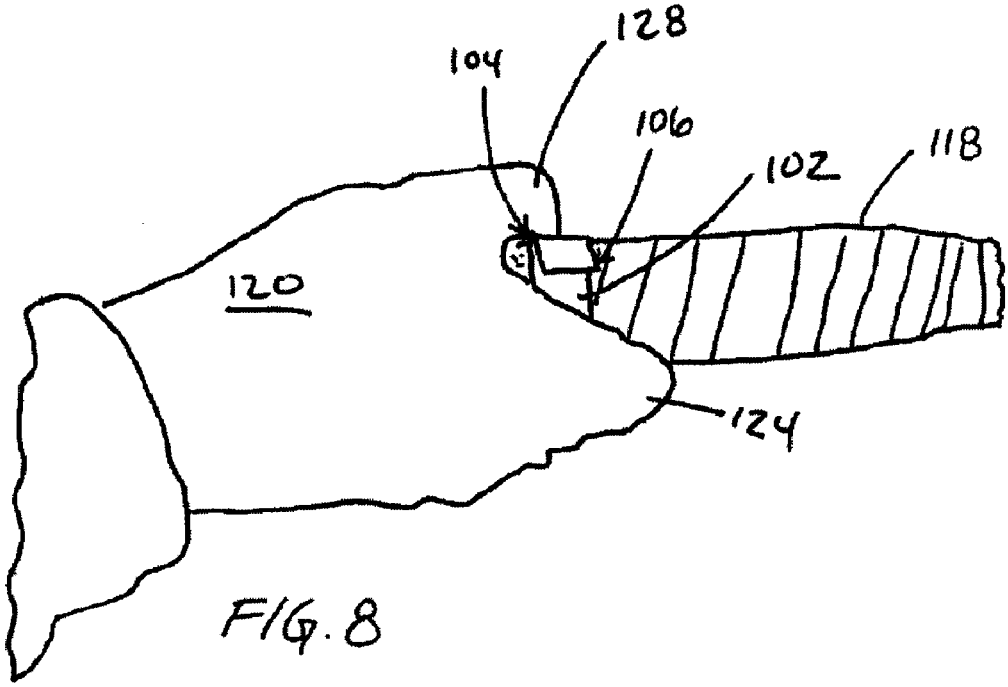
FIG. 8 is a top view of the right-handed grip of FIG. 7 showing a manner of removably attaching the grip trainer to a tennis racquet handle.

FIGS. 7 and 8 are perspective views illustrating how the grip trainer of FIGS. 1-3 or the grip trainer of FIGS. 4-6 may be grasped during use. FIG. 7 is a side view showing an illustrative grip of a tennis racquet handle 118 and placement of the finger projection 112 between the index finger 124 and middle finger 126. FIG. 8 is a top view showing the overlapping of ends 106 and 104, as described above, and the placement of thumb 128 along a side of the racquet handle 118 that is opposite the side of the racquet handle 118 from which the finger projection 112 outwardly projects.

Referring to FIGS. 7 and 8, the player grasps the racquet handle 118 with a hand 120 so that the grip trainer's finger projection 112 rests between the index finger 124 and the middle finger 126 and abuts the web 128 that bridges between the index finger 124 and the middle finger 126. In this manner, the finger projection 112 prevents the hand 120 from moving up or down the longitudinal axis of the racquet handle 118. Additionally, the finger projection 112 virtually eliminates over-rotation of the hand because abutment of the web 128 against the finger projection 112 prevents the hand 120 from slipping to the right. Unlike conventional gripping devices, a grip trainer constructed according to the principles of the invention may be used for serving, backhand play, and forehand play.

In one embodiment of the invention, the outer surface of the racquet handle 118 may include alignment marks at different positions so that the grip trainer 100, 200 can be easily, quickly, and correctly placed for backhand play, forehand play, and serving. In another embodiment of the invention, the finger projection 112 may be integrally formed with the strip 102.

While the invention has been described in terms of exemplary embodiments, those skilled in the art will recognize that the invention can be practiced with modifications in the spirit and scope of the appended claims. The examples given above are merely illustrative and are not meant to be an exhaustive list of all possible designs, embodiments, applications or modifications of the invention. For example, while the grip trainer invention has been described in relation to tennis racquets, it may also be used in other racquet sports such as squash, racquet-ball, badminton, and the like.

What is claimed is:

1. A grip trainer for positioning a user's hand on a sports racquet, said grip trainer comprising:

a substrate configured to removably attach to the sports racquet handle in a plurality of different positions corresponding to different grips related to the sport for which the racquet is designed for use;

a finger positioning device comprising a generally cylindrical projection extending upwardly from said substrate and configured to position the user's hand on the racquet handle in one of the plurality of positions; and a stiffener disposed between a portion of said substrate and said projection.

2. The grip trainer of claim 1, further comprising an attachment member connecting said projection to said flexible substrate.

3. The grip trainer of claim 2, wherein said attachment member comprises one of a rivet and a screw.

4. The grip trainer of claim 3, wherein said attachment member comprises a threaded cap and said screw.

5. The grip trainer of claim 1, wherein said projection comprises a plastic member having at least a partially hollow portion therein.

6. The grip trainer of claim 1, wherein said substrate includes a fastening mechanism to removably attach the grip trainer to the racquet.

7. The grip trainer of claim 1, wherein the sports racquet is a tennis racquet and the position includes forehand, backhand, and serving.

8. The grip trainer of claim 1, wherein the width of said substrate is approximately equal to or greater than the diameter of said generally cylindrical projection.

* * * * *